US009226065B2

(12) United States Patent
Weitnauer et al.

(10) Patent No.: US 9,226,065 B2
(45) Date of Patent: Dec. 29, 2015

(54) INTERPOLATION CIRCUIT FOR INTERPOLATING A FIRST AND A SECOND MICROPHONE SIGNAL

(71) Applicant: INSTITUT FUR RUNDFUNKTECHNIK GMBH, Munich (DE)

(72) Inventors: Michael Weitnauer, Munich (DE); Michael Meier, Munich (DE); Jens Groh, Munich (DE)

(73) Assignee: INSTITUT FUR RUNDFUNKTECHNIK GMBH, Munich (DE)

( * ) Notice: Subject to any disclaimer, the term of this patent is extended or adjusted under 35 U.S.C. 154(b) by 89 days.

(21) Appl. No.: 14/349,463

(22) PCT Filed: Oct. 5, 2012

(86) PCT No.: PCT/EP2012/069799
§ 371 (c)(1),
(2) Date: Apr. 3, 2014

(87) PCT Pub. No.: WO2013/050575
PCT Pub. Date: Apr. 11, 2013

(65) Prior Publication Data

US 2014/0286508 A1 Sep. 25, 2014

(30) Foreign Application Priority Data

Oct. 5, 2011 (IT) ..... TO2011A0890

(51) Int. Cl.
*H04R 3/00* (2006.01)
*H04R 5/027* (2006.01)

(52) U.S. Cl.
CPC ..... *H04R 3/00* (2013.01); *H04R 3/005* (2013.01); *H04R 5/027* (2013.01); *H04S 2400/15* (2013.01)

(58) Field of Classification Search
None
See application file for complete search history.

(56) References Cited

U.S. PATENT DOCUMENTS 5,550,900 A 8/1996 Ensor et al.
6,539,096 B1 3/2003 Sigwanz et al.
(Continued)

FOREIGN PATENT DOCUMENTS

DE 198 14 180 C1 10/1999
DE 102009052992 3/2011
(Continued)

OTHER PUBLICATIONS

International Search Report dated Dec. 21, 2012, issued in PCT Application No. PCT/EP2012/069799, filed Oct. 9, 2012.
(Continued)

*Primary Examiner* — Paul Huber
(74) *Attorney, Agent, or Firm* — Workman Nydegger

(57) ABSTRACT

An interpolation circuit for interpolating a first and a second microphone signal and for generating an interpolated microphone signal includes a first input (100) for receiving the first microphone signal (am), a second input (101) for receiving the second microphone signal (am+1), an output (102) for outputting the interpolated microphone signal (s), a control input (103) for receiving a control signal (r), and a first circuit branch (104) including first (105) and second (106) inputs coupled to the first (100) and the second (101) input, respectively, of the interpolation circuit, and an output (107) coupled to the output (102) of the interpolation circuit, wherein the first circuit branch is provided with a means (108) for power-specific summing of the signals supplied to the first and second inputs of the first circuit branch and for outputting a power-specific summation signal at the output (107) of the first circuit branch (104).

13 Claims, 7 Drawing Sheets

(56) References Cited

U.S. PATENT DOCUMENTS

| | | | |
|---|---|---|---|
| 7,274,794 | B1 | 9/2007 | Rasmussen |
| 7,317,801 | B1 | 1/2008 | Amir |
| 7,720,232 | B2 | 5/2010 | Oxford |
| 8,483,854 | B2 | 7/2013 | Nagaraja et al. |
| 2004/0076301 | A1 | 4/2004 | Algazi et al. |
| 2006/0282262 | A1 | 12/2006 | Vos et al. |
| 2009/0175466 | A1 | 7/2009 | Elko et al. |
| 2009/0192803 | A1 | 7/2009 | Nagaraja et al. |
| 2012/0237055 | A1 | 9/2012 | Groh |

FOREIGN PATENT DOCUMENTS

| | | | |
|---|---|---|---|
| EP | H06334457 | A | 12/1994 |
| EP | 1 928 110 | A2 | 6/2008 |
| TW | 280903 | B | 7/1996 |
| TW | 200842827 | | 11/1996 |
| TW | 200947422 | | 9/1997 |
| TW | 200515695 | | 5/2005 |
| TW | 200623923 | | 7/2006 |
| TW | I 324336 | | 5/2010 |
| WO | 2006/116025 | A1 | 11/2006 |
| WO | 2011/057922 | A1 | 5/2011 |

OTHER PUBLICATIONS

International Preliminary Report on Patentability and Written Opinion dated Apr. 8, 2014, issued in PCT Application No. PCT/EP2012/069799, filed Oct. 5, 2012.

Taiwanese Search Report dated Sep. 18, 2014, issued in TW 101137014, filed Oct. 5, 2012.

Fig. 3
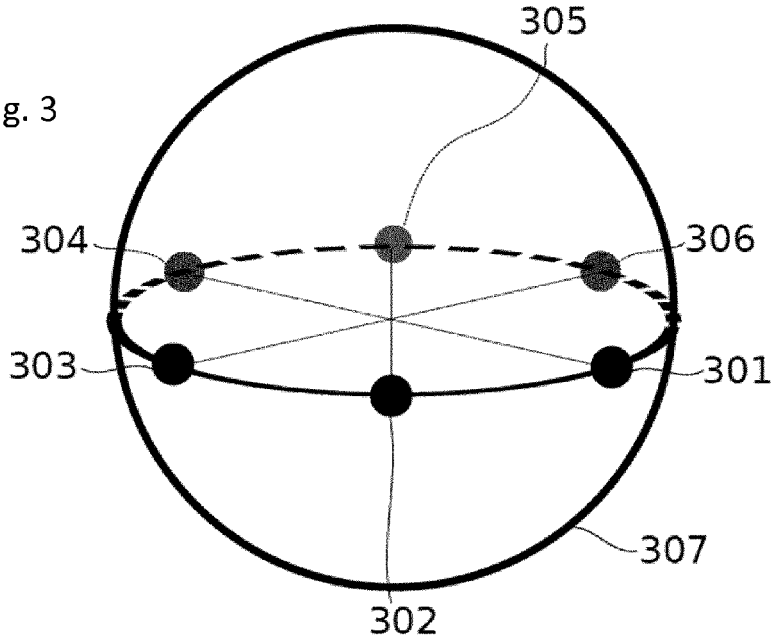
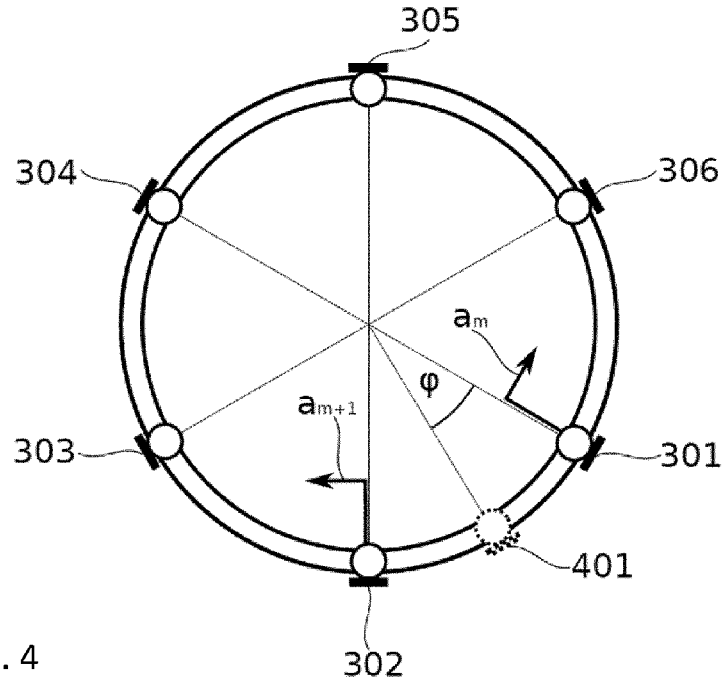
Fig. 4

INTERPOLATION CIRCUIT FOR INTERPOLATING A FIRST AND A SECOND MICROPHONE SIGNAL

INTRODUCTION TO THE DESCRIPTION

The invention relates to an interpolation circuit in accordance with the preamble of claim 1. As defined therein, this interpolation circuit includes a first branch provided with a circuit for power-specific summation of the first and second microphone signals. A possible embodiment of such a circuit for power-specific summation is known from WO2011/057922A1. In the context of the present invention, a circuit for power-specific summation is to be understood as a circuit deriving an output signal based on two input signals, with the proviso that the power of the output signal is mainly equal to the sum of the power quantities of the two input signals.

Each interpolation method is based on a weighted summation of two signals. The summation signal can, however, only be interpolated correctly up to a particular frequency or wavelength at which the sampling theorem is still satisfied. Thus, a signal can only be calculated correctly if the distance between the microphones to be interpolated is not greater than half the wavelength. Beyond this, the phase can not be determined in a defined manner any more, resulting in comb filters and corresponding sound colorations.

The latter are prevented through power-specific summation in the interpolation method, as is described in WO2011/057922A1. As a result it is possible to simulate a virtual microphone in the desired location without any sound losses.

The invention intends to further improve the interpolation circuit. To this end, the interpolation circuit defined in the preamble of the main claim is characterized as specified in accordance with the features of the characterizing portion of the main claim. Preferred practical examples of the interpolation circuit of the invention are defined in the subclaims.

The invention is based on the following inventive concept.

The localized perception of sound waves is substantially determined by the delay periods of the sound paths of low-frequency sound components. As these delay periods are represented in the phase of the corresponding low-frequency signal components, a correct phase of the virtual microphone signal is crucial for an unimpaired localized perception. The phase of the virtual microphone signal is a function of the location variable determining the position of the virtual microphone.

The correct delay period values, or phase values, of a virtual microphone are mapped with adequate accuracy for sufficiently low-frequency signal components by a traditional interpolation of real microphone signals; such an interpolation shall in the following be referred to as phase-specific interpolation.

The acoustic perception of sound sources is substantially determined by the ratios of the acoustic power of sound components of different frequencies, however is independent of whether or not the phase of the signal is correct.

With the exception of low-frequency signal components, the traditional interpolation is not suited due to infraction of the sampling condition because it falsifies the power ratios of different frequencies while also not providing a correct phase of the virtual microphone signal.

It is a property of frequency-dependent, approximately constant-power interpolation, hereinafter referred to as power-specific interpolation, that it does not substantially alter the power ratios of different frequencies and therefore results in a sound perception of the virtual microphone which approximately corresponds to the one of a real microphone in the corresponding position.

Inasmuch as a power-specific interpolation is not necessarily also phase-specific, an improvement of the localized perception is achieved by restricting the power-specific interpolation to high-frequency signal components and combining it with a phase-specific interpolation for the remaining, low-frequency signal components. This in turn is achieved in that processing is distributed to two different branches.

Further details also result from the following further reflections.

Power-specific interpolation is realized by the application of power-related weighting factors to the input signals of a power-specific summer, wherein the summation as in WO2011/057922A1 is employed for the power-specific summer, and the weighting factors are power-related in that the sum of their squared values is 1.

Processing of the microphone signals in the frequency range, which serves the purpose of power-specific interpolation, is advantageously employed concurrently for a separation between low-frequency and high-frequency signal components.

Combining of the two interpolation types is executed by weighted mixing of the signals of the two processing branches in dependence on the frequency parameter, wherein the weighting factors are a continuous function of the frequency. This largely prevents the generation of discontinuities in the frequency spectrum of the combined signal which would otherwise result in audible interferences for some signals.

If the calculation of the interpolated signal value of the corresponding frequency and the corresponding interpolation type is omitted for those frequencies and the one processing branch where the weighting factor of mixing is zero, this brings about the advantage of saving a part of the processing expenditure.

The selection of a summer for the power-specific interpolation, the phases of which are a smooth function of the weighted input signals, has the effect that interfering disruptions in sound perception are not produced during a continuous change of the control signal of the virtual microphone. The summation as in WO2011/057922A1 meets this requirement and is therefore utilized.

Both in a traditional interpolation and a power-specific interpolation, the phase function of the location variable of the virtual microphone in most cases deviates from the phase function of a real microphone placed in the position of the virtual microphone. The phase values of the virtual microphone are mapped with improved accuracy in that the location variable is converted to a control signal of the interpolation by an antidistortion calculation. Approximating calculations are sufficient. The antidistortion function typically maps the value 0 to 0 and the value 1 to 1, and the development in between typically is symmetrical.

The most simple approximation is the proportionality function.

A further improvement of the phase values of the virtual microphone is achieved by adapting the phase function of the power-specific interpolation to the phase function of the traditional interpolation. This prevents interfering amplitude errors during transition between the two interpolation types in the frequency range of changeover between the signal contributions of the processing branches, and is achieved by employing separate, different antidistortion calculations for the control signals of the two interpolations. A typical, sufficiently accurate antidistortion function for the control signal of the traditional interpolation is the proportionality function. A typical, sufficiently accurate antidistortion function for the control signal of the power-specific interpolation is the squared sine function.

SHORT DESCRIPTION OF THE FIGURES

The invention is explained in more depth by making reference of the description of the figures, wherein FIG. 1 shows a practical example of the interpolation circuit of the invention, FIG. 2 shows a detailed circuit of the means for power-specific summation in the first branch of the interpolation circuit of FIG. 1, FIG. 3 shows a practical example of a microphone arrangement in a lateral view, FIG. 4 is a sectional top view of the microphone arrangement of FIG. 3, with several microphones arranged on a peripheral circle, FIG. 5 shows a second practical example of the microphone arrangement, FIG. 6 shows a second practical example of the means for power-specific summation, FIG. 7 shows a third practical example of the means for power-specific summation, and FIG. 8 shows a second practical example of the interpolation circuit of the invention.

Figure 1:
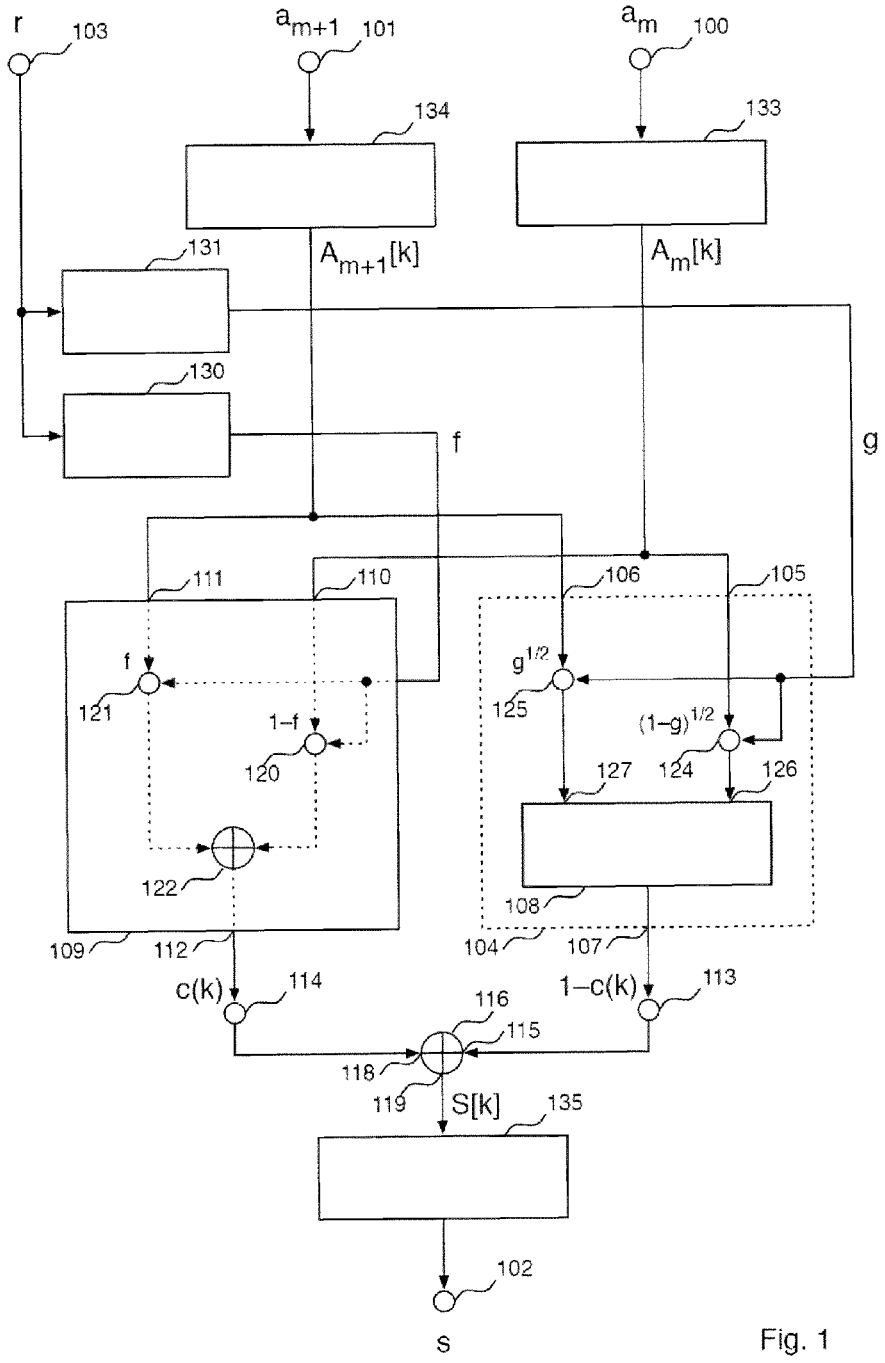
FIG. 1 shows a practical example of the interpolation circuit. The interpolation circuit is provided with a first input 100 for receiving a first microphone signal ($a_m$), a second input 101 for receiving a second microphone signal ($a_{m+1}$), an output 102 for outputting an interpolated microphone signal (s), and a control input 103 for receiving a control signal (r). The interpolation circuit is further provided with two circuit branches, namely, a first circuit branch 104 having first 105 and second 106 inputs that are coupled to the first 100 and the second 101 input of the interpolation circuit, respectively, and an output 107 that is coupled to the output 102 of the interpolation circuit, and a second circuit branch 109 having first 110 and second 111 inputs that are coupled to the first 100 and the second 101 input of the interpolation circuit, respectively, and an output 112 that is coupled to the output 102 of the interpolation circuit.

The first circuit branch 104 is provided with a means 108 for power-specific summation of the signals supplied at the first 105 and second 106 inputs of the first circuit branch and for outputting a power-specific summation signal at the output 107 of the first circuit branch 104.

The first circuit branch 104 is further provided with a multiplication circuit 124 coupled between the first input 105 of the first circuit branch and a first input 126 of the means 108 for power-specific summation. The circuit branch 104 is furthermore provided with a multiplication circuit 125 coupled between the second input 106 of the first circuit branch and a second input 127 of the means for power-specific summation. The multiplication circuits 124, 125 are each provided with a control input that is coupled to the control input 103 of the interpolation circuit via a control signal conversion circuit 131.

The second circuit branch 109 is provided with a first multiplication circuit 120 and a second multiplication circuit 121 having inputs coupled to the first 110 and the second input 111, respectively, of the second circuit branch, and outputs coupled to respective inputs of a second signal combination circuit 122, the output of which is coupled to the output 112 of the second circuit branch 109. The first and second multiplication circuits 120, 121 are each provided with a control input that is coupled to the control input 103 of the interpolation circuit via a control signal conversion circuit 130.

The respective outputs 107, 112 of the first and second circuit branches 104 and 109 are coupled to respective inputs 115, 118 of a signal combination circuit 116 via respective multiplication circuits 113 and 114. An output 119 of the signal combination circuit 116 is coupled to the output 102 of the interpolation circuit.

Interpolation is preferably carried out in the frequency range. In this case transformation circuits 133 and 134 are provided which convert the microphone signals from the time range into the frequency range, e.g. by means of fast Fourier transform, and having a transformation circuit 135 which converts the output signal of the signal combination circuit 116 from the frequency range into the time range, e.g. by means of inverse fast Fourier transform.

The multiplication circuits 120, 121 are adapted to multiply the signals supplied to them by first and second multiplication factors (1−f,f), wherein first and second multiplication factors are dependent on the control signal (r). In a preferred manner, $$f=r^B, \qquad \text{(Eq. 1)},$$

wherein B is a constant that is greater than zero, preferably equal to 1.

The multiplication circuits 124,125 are adapted to multiply the signals supplied to them by third and fourth multiplication factors that are equal to $(1-g)^{1/2}$ and $g^{1/2}$, wherein third and fourth multiplication factors are dependent on the control signal (r). The factor g may be dependent on r in various ways. One possibility is $$g=r^C \qquad \text{(Eq. 2)},$$

wherein C is a constant that is greater than zero, preferably equal to 1. In this case it is achieved that the signal at the output 107 of the first branch 104 is adapted to the signal at the output 112 of the second branch 109 in the amplitude as well as in simple approximation of the phase. Or, $g=\sin^D(r*\pi/2)$, wherein D is a constant that is greater than zero, preferably equal to 2. In this case the same conditions apply as in the case $g=r^C$ wherein, however, the accuracy of approximation of the phase is additionally improved. The multiplication circuits 113 and 114 are adapted to multiply the signals supplied to them by respective frequency-dependent multiplication factors 1−c(k) and c(k), wherein k is a frequency parameter. In a preferred embodiment a condition for c(k) is that for k=0 it is a constant $E_1$ that is preferably equal to 1 and decreases for increasing values of k until c(k) is equal to a constant $E_0$, preferably equal to 0, for higher values of k. Conversely, it is thus true for the multiplication factor 1−c(k) that it is $1-E_1$ for k=0 and increases for increasing values of k until it becomes $1-E_0$ for higher values of k. This means that the contribution of the second branch 109 is mainly in the low frequency range, however that this contribution decreases for higher frequencies and is taken over by the contribution of the first branch 104.

Figure 2:
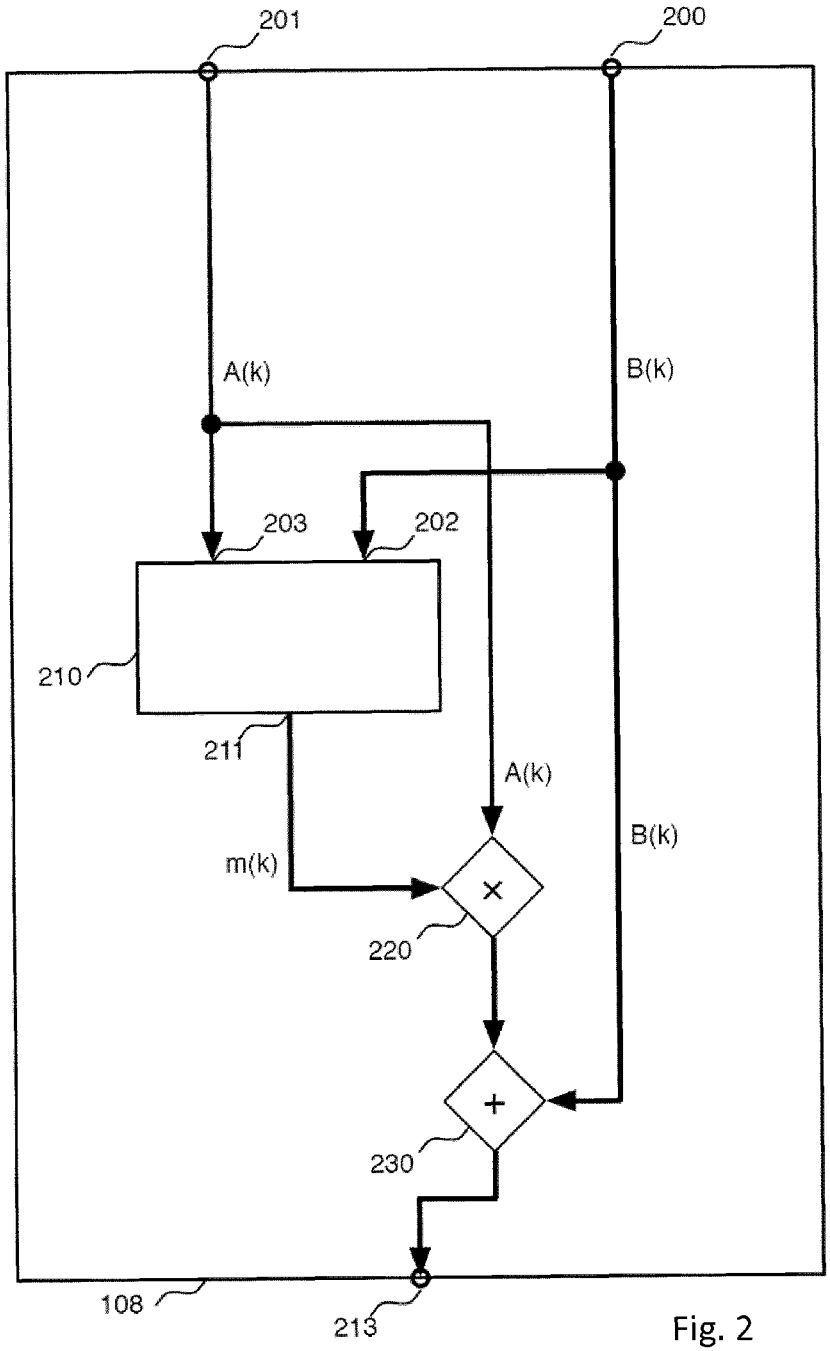

FIG. 2 shows a possible practical example of the means 108 for power-specific summation in the first branch 104 in the interpolation circuit of FIG. 1.

The means 108 for power-specific summation as shown in FIG. 2 contains a calculation unit 210, a multiplication circuit 220, and a signal combination unit 230. The inputs 201 (127 in FIG. 1) and 200 (126 in FIG. 1) of the means for power-specific summation are coupled to a respective first and second input 203 and 202 of the calculation unit 210. The inputs 201, 200 of the means for power-specific summation may basically also be identified in reversed association, to be 126 and 127 in FIG. 1. One output 211 of the calculation unit 210 is coupled to a first input of the multiplication circuit 220. One input of the means 108 for power-specific summation is coupled to a second input of the multiplication circuit 220. One output of the multiplication circuit 220 is coupled to a first input of the signal combination unit 230. Another input of the means 108 for power-specific summation is coupled to a second input of the signal combination unit 230. One output of the signal combination unit 230 is coupled to the output 213 of the means 108, wherein output 213 is coupled to the output 107 of the first circuit branch 104. The calculation unit 210 is adapted to derive a multiplication factor m(k) in dependence on the signals at the inputs 202 and 203 of the calculation unit.

FIG. 3 shows a practical example of a microphone arrangement in a lateral view, wherein the interpolation circuit of FIG. 1 may be employed. FIG. 3 shows a spherical surface microphone arrangement, with six microphones 301 to 306 being arranged at the surface of a sphere 307 in this case. FIG. 4 shows a top view of a horizontal section through the sphere of the microphone arrangement of FIG. 3. The six microphones are arranged at a peripheral circle of the section. Two juxtaposed microphones such as, e.g., the microphones 301 and 302, are connected to the respective inputs 100 and 101 of the interpolation circuit of FIG. 1. By means of the interpolation circuit of FIG. 1 it is now necessary to derive a microphone signal as if it were the output signal of one microphone arranged in a virtual position on the circle between the microphones 301 and 302 as indicated at 401 in FIG. 4. This position is defined by the corner position $\phi$. $\phi$ thus is a corner variable that may vary between $\phi_m$ and $\phi_{m+1}$, wherein $\phi_m$ and $\phi_{m+1}$ are the corner positions of the two microphones 301 and 302 on the peripheral circle.

With regard to a practical example where an interpolated microphone signal is derived from two microphone signals of two juxtaposed microphones of the microphone arrangement in FIGS. 3 and 4, the following may be noted in regard of the control signal r:

$$r=A*(\phi-\phi_m)/(\phi_{m+1}-\phi_m) \quad \text{(Eq. 3)}$$

wherein A is a constant that is preferably equal to 1, and wherein $\phi_m$ and $\phi_{m+1}$ are the corner positions of the two microphones 301 and 302 on the circle and $\phi$ is a corner variable indicating the corner position where a virtual microphone between the two microphones is assumed to be arranged on the circle, and wherein the interpolated microphone signal at the output of the interpolation circuit is assumed to be the output signal of this virtual microphone.

The operation of the interpolation circuit according to FIGS. 1 and 2 is described in the following.

It shall be assumed that the position of the virtual microphone may be described through a parametric interpolation of location along a suitably devised connecting line between the positions of the adjacent real microphones 301, 302, that the parameter of this interpolation of location is scaled by an appropriately defined scaling function so that the scaling yields 0 at the position of the microphone 301 and 1 at the position of the microphone 302, and that the scaling result is adopted as the control signal r of the circuit in FIG. 1. Thus equaling the parameter in the transposition of an interpolation of location to a signal interpolation is assumed to be known and to be reasonable for the present acoustic field of application.

For example, in the arrangement in FIG. 3 and FIG. 4 the assumed parameterized connecting line is a circular line section at the ends of which the microphones 301, 302 are situated, with the parameter being an coordinate of angle of the circular line.

The circuit in FIG. 1 realizes the inventive concept by executing both types of interpolation, namely, a power-specific signal interpolation and a phase-specific signal interpolation. The signal paths are branched into two partial circuits—one each for the respective interpolation type—and recombined again.

All of such branching and recombination is carried out with signals transformed into the frequency range, and the operations in the branches relate to spectral values. The spectral values of the input signals are each generated from the respective input signal by a spectral transformation unit in the input signal path, and the output signal is generated from the spectral values of the output signal by an inverse spectral transformation unit in the output signal path. This spectral processing enables power-specific summation and the transition of the interpolation types, which shall be elucidated further below.

Spectral values should be understood to be vector variables having a frequency as an index, and each vector element is processed in the same manner. In difference from this, an improved example realization for a vector element only carries out the operations of a branch if the weighting factor of the branch in question and of the frequency index in question is not 0 upon recombination of the branches. The weighting factors of the recombination shall be explained in more detail further below.

The interpolations are each composed of an application of weighting factors to the input spectral values and of a summation, wherein the weighting factors of the interpolation are controlled by a control variable.

The power-specific signal interpolation meets the condition that the output power should be approximately equal to the sum of the input power, in that both the involved summation meets this condition (power-specific summation), and furthermore in weighting the sum of the output powers is equal to the sum of the input powers. In weighting this condition is met due to the fact that the squared weighting factors add up to 1.

The operation of a power-specific summation will be described further below in the explanations for FIG. 2 through the example of summation as in WO2011/057922A1.

The phase-specific interpolation is a linear interpolation which operates in a manner that is known per se.

In order for each interpolation type to obtain a frequency-dependent proportion of its effect, frequency-dependent weighting factors are applied to the spectral values upon recombination of the signal branches. The weighting factors of the recombination expediently add up to 1.

The transition range of the interpolation types is realized through the frequency-dependent weighting of the recombination. The curve of the frequency dependency is preferably smooth, whereby audible interferences in the resultant signal are prevented.

The location of the transition range with regard to the frequency is advantageously selected such that the power ratios of different frequencies are not yet altered strongly by the phase-specific interpolation for frequencies below the transition range. This approximately comes about for a frequency in an order where the distance of the adjacent real microphones is one quarter of the wavelength of a sound wave propagating in the direction of the connecting line.

The antidistortion calculation for the control variable of the interpolation that is provided for the improvement of the phase values of the virtual microphone at frequencies in the transition range of the interpolation types is carried out separately for the two branches by respective control signal conversion circuits 130 and 131. The antidistortion function is realized through an antidistortion curve which is selected to compensate the phase characteristics of the signal interpolation such as to approximate it to the phase characteristics of the interpolation of location. For example, the antidistortion curve is determined in advance through comparisons of phase measurements or phase estimates with a real microphone and phase measurements or phase estimates with the aid of the present circuit. The expression "phase characteristics" refers to the dependency of the phase of an interpolated spectral value on the control variables of the interpolation and on the respective spectral values to be interpolated. The antidistortion can only compensate the dependency on the control variables, not the dependency on the two spectral values to be interpolated. For determining the antidistortion curve it is therefore expedient to consider only those case where the influence of the spectral values to be interpolated is small, and an average or typical case is assumed. Those are the cases in which the difference of the phases of the spectral values to be interpolated is small, which is true for the typical acoustic applications at sufficiently low frequencies and thus also for the intended transition range of the interpolation types.

Identifying the inputs 201, 200 of the means 108 for power-specific summation as 127 or 126 in FIG. 1 or vice versa, i.e., 126 and 127 in FIG. 1 only has an effect on the phase of the spectral values of the branch for power-specific signal interpolation. The effect of the entire circuit remains very similar. Differences in the phase of the output signal, which have no significant effect on localized perception and sound perception, only occur for frequencies above the transition range. Despite the non-symmetrical construction of the power-specific summation it is therefore insignificant which microphone is associated to which input.

In summary it may be said that the operation of the partial circuits of the two signal branches differs in the following points:

- type of summation.
- weighting factors of the interpolation.
- control variable of the interpolation.
- distortion suppression of the control variables of the interpolation.
- frequency-dependent weighting factors of the recombination.

Altogether, the comportment of the circuit with regard to the phase may be described as follows: For signal components in the range of high frequencies only the first branch takes effect, in which the phase resulting from ensuring the correct power of the interpolation is not taken into account. For signal components in the range of low frequencies only the second branch takes effect, which ensures the correct phase of the interpolation. In a transition range at medium frequencies a combination of both branches takes effect in with the branches change over continually and exhibit only a small difference, if any, in their phase.

The circuit in FIG. 2 fundamentally carries out an addition of the spectral values supplied at its inputs, however this by itself would still not allow to obtain the power from the inputs to the output. For this reason the amplitude of one of the two input spectral values is corrected additionally prior to the addition. The correction is carried out for every frequency index k by multiplying this input spectral value $Z_1(k)$ by a factor m(k), wherein the factor is calculated based on the target value for the output power and the given input spectral values.

The given arrangement results in a calculated k-th complex output spectral value Y(k) of the signal at the output 213 of the means 108 as $$Y(k)=m(k)\cdot Z_1(k)+Z_2(k). \quad \text{(Eq. 4)}$$

In analogy with the method of WO2011/057922A1, the multiplication factor m(k) is calculated as follows:

$$eZ_1(k)=\mathrm{Real}(Z_1(k))\cdot\mathrm{Real}(Z_1(k))+\mathrm{Imag}(Z_1(k))\cdot\mathrm{Imag}(Z_1(k)) \quad \text{(Eq. 5.1)}$$

$$eZ_2(k)=\mathrm{Real}(Z_2(k))\cdot\mathrm{Real}(Z_2(k))+\mathrm{Imag}(Z_2(k))\cdot\mathrm{Imag}(Z_2(k)) \quad \text{(Eq. 5.2)}$$

$$x(k)=\mathrm{Real}(Z_1(k))\cdot\mathrm{Real}(Z_2(k))+\mathrm{Imag}(Z_1(k))\cdot\mathrm{Imag}(Z_2(k)) \quad \text{(Eq. 5.3)}$$

$$w(k)=x(k)/(eZ_1(k)+L\cdot eZ_2(k)) \quad \text{(Eq. 5.4)}$$

$$m(k)=(w(k)^2+1)^{1/2}-w(k) \quad \text{(Eq. 5.5)}$$

wherein

- m(k) designates the k-th multiplication factor
- $Z_1(k)$ designates the k-th complex spectral value of the signal at the input 203 of the calculation unit 210
- $Z_2(k)$ designates the k-th complex spectral value of the signal at the input 202 of the calculation unit 210
- L designates the degree of limitation of the comb filter compensation.

The degree L of limitation of the comb filter compensation is a numerical value which determines the degree in which the probability of the occurrence of artefacts perceived to be interfering is reduced. This probability is given when the amplitude of the spectral values of the signal at the input 203 of the calculation unit is small compared with that of the spectral value of the signal at the input 202 of the calculation unit. At a condition of L>=0, L typically is constant and L<1. If L=0, a reduction of the probability of artefacts does not ensue. The greater L, the lower is the probability of artefacts, however this equally has the effect of partially reducing the compensation of sound colorations due to comb filter effects that is aimed at by the circuit. L is selected such that artefacts just about are not perceived any more in accordance with experience.

It will now be shown that the power ratios of different frequencies between the inputs and the output of the means 108 for power-specific summation are not altered substantially.

To this end the sum of the input spectral powers is compared to the output spectral power for a frequency index k.

The respective spectral power values $eZ_1(k)$ and $eZ_2(k)$ for the complex input spectral values $Z_1(k)$ and $Z_2(k)$ were already indicated in (Eq. 5.1) and (Eq. 5.2), and in the same way there results for the k-th spectral power value eY(k) of the signal at the output 213 of the means 108

$$eY(k)=\mathrm{Real}(Y(k))\cdot\mathrm{Real}(Y(k))+\mathrm{Imag}(Y(k))\cdot\mathrm{Imag}(Y(k)).$$

When L=0 is assumed and substituted in the equation (Eq. 5.4) given above, the equation is simplified to $$w_0(k)=x(k)/eZ_1(k),$$

and with $w_0(k)$ instead of w(k) and with corresponding substitutions $$m_0(k)=(w_0(k)^2+1)^{1/2}-w_0(k)$$

and $$Y_0(k)=m_0(k)\cdot Z_1(k)+Z_2(k)$$

it is possible by well-known mathematical processes to thereby solve an equation $$eY_0(k)=eZ_1(k)+eZ_2(k),$$

which shows the accurate equality of output power and sum of the input powers at L=0.

The application of the parameter L with L>0 results in a deviation from the accurate equality of power for the single frequency index k, with the ensuing restriction of:

$$eY(k)\approx eZ_1(k)+eZ_2(k),$$

whereas L>0 has the advantageous effect of the probability of the occurrence of artefacts perceived as interfering being reduced.

These artefacts may come about with the named $w_0(k)$ because a zero crossing of $Z_1(k)$, even if it is continuous, results in a non-continuous polarity reversal of $Y_0(k)$, and they may be perceived as interfering if the contribution of the spectral proportion thereby effected to the overall signal is sufficiently great. The discontinuity is eliminated by L>0.

The interpolation circuit of FIG. 1 operates as follows.

As was already mentioned, this circuit generates an interpolated signal at the output 102 for a virtual microphone assumed to be arranged in the position 401 on the circle in FIG. 4. The output signal at the output 102 is thus dependent on $\phi$ and changes as follows at values of $\phi$ varying from $\phi=\phi_m$ to $\phi=\phi_{m+1}$. For $\phi=\phi_m$, it may be derived from Formula (Eq. 3) that r=0. Accordingly, due to Formula (Eq. 1), there also follows f=0, and due to Formula (Eq. 3) there also follows g=0. It is thus evident from FIG. 1 that the signal $a_m$ (as expected) is passed through as an output signal at the output 102.

For $\phi=\phi_{m+1}$, it may be derived from Formula (Eq. 3) that r=1. Accordingly, due to Formula (Eq. 1) there also follows f=1, and due to Formula (Eq. 3) there also follows g=1. It is thus evident from FIG. 1 that the signal $a_{m+1}$ (as expected) is passed through as an output signal at the output 102.

For $\phi$ situated between $\phi_m$ and $\phi=\phi_{m+1}$, the Formulae (Eq. 1), (Eq. 2), (Eq. 3) and (Eq. 4) are to be applied. The k-th complex spectral value S[k] of the output signal s of the virtual microphone in the location $\phi$ as a function of $\phi$, c(k), $A_m[k]$ and $A_{m+1}[k]$ then has the following form:

$$\begin{aligned}S[k]=(((((&\mathrm{Real}(((r(\phi))^{C})^{1/2}\cdot A_{m+1}[k])\cdot\mathrm{Real}((1-(r(\phi))^{C})^{1/2}\cdot A_m[k])+\mathrm{Imag}(((r(\phi))^{C})^{1/2}\cdot A_{m+1}[k])\cdot\mathrm{Imag}((1-(r(\phi))^{C})^{1/2}\cdot A_m[k]))/((\mathrm{Real}(((r(\phi))^{C})^{1/2}\cdot A_{m+1}[k])\cdot\mathrm{Real}(((r(\phi))^{C})^{1/2}\cdot A_{m+1}[k])+\mathrm{Imag}(((r(\phi))^{C})^{1/2}\cdot A_{m+1}[k])\cdot\mathrm{Imag}(((r(\phi))^{C})^{1/2}\cdot A_{m+1}[k]))+L\cdot\\&(\mathrm{Real}((1-(r(\phi))^{C})^{1/2}\cdot A_m[k])\cdot\mathrm{Real}((1-(r(\phi))^{C})^{1/2}\cdot A_m[k])+\mathrm{Imag}((1-(r(\phi))^{C})^{1/2}\cdot A_m[k])\cdot\mathrm{Imag}((1-(r(\phi))^{C})^{1/2}\cdot A_m[k]))))^2+1)^{1/2}-((\mathrm{Real}(((r(\phi))^{C})^{1/2}\cdot A_{m+1}[k])\cdot\mathrm{Real}((1-(r(\phi))^{C})^{1/2}\cdot A_m[k])+\\&\mathrm{Imag}(((r(\phi))^{C})^{1/2}\cdot A_{m+1}[k])\cdot\mathrm{Imag}((1-(r(\phi))^{C})^{1/2}\cdot A_m[k]))/((\mathrm{Real}(((r(\phi))^{C})^{1/2}\cdot A_{m+1}[k])\cdot\mathrm{Real}(((r(\phi))^{C})^{1/2}\cdot A_{m+1}[k])+\mathrm{Imag}(((r(\phi))^{C})^{1/2}\cdot A_{m+1}[k])\cdot\mathrm{Imag}(((r(\phi))^{C})^{1/2}\cdot A_{m+1}[k]))+L\cdot\\&(\mathrm{Real}((1-(r(\phi))^{C})^{1/2}\cdot A_m[k])\cdot\mathrm{Real}((1-(r(\phi))^{C})^{1/2}\cdot A_m[k])+\mathrm{Imag}((1-(r(\phi))^{C})^{1/2}\cdot A_m[k])\cdot\mathrm{Imag}((1-(r(\phi))^{C})^{1/2}\cdot A_m[k]))))\cdot(((r(\phi))^{C})^{1/2}\cdot A_{m+1}[k])+((1-(r(\phi))^{C})^{1/2}\cdot A_m[k]))\cdot(1-c(k))+\\&(((r(\phi))^{B}\cdot A_{m+1}[k])+((1-(r(\phi))^{B})\cdot A_m[k]))\cdot c(k),\end{aligned}$$

with $$r(\phi)=A\cdot(\phi-\phi_m)/(\phi_{m+1}-\phi_m). \quad \text{(Eq. 6)}$$

Or, when expressed in the form of single calculation steps:

$$r=A\cdot(\phi-\phi_m)/(\phi_{m+1}-\phi_m) \quad \text{(Eq. 6.1)}$$

$$U_1(k)=(r)^{B}\cdot A_{m+1}[k] \quad \text{(Eq. 6.2)}$$

$$U_2(k)=(1-(r)^{B})\cdot A_m[k] \quad \text{(Eq. 6.3)}$$

$$U(k)=(U_1(k))+(U_2(k)) \quad \text{(Eq. 6.4)}$$

$$Z_1(k)=((r)^{C})^{1/2}\cdot A_{m+1}[k] \quad \text{(Eq. 6.5)}$$

$$Z_2(k)=(1-(r)^{C})^{1/2}\cdot A_m[k] \quad \text{(Eq. 6.6)}$$

$$eZ_1(k)=\mathrm{Real}(Z_1(k))\cdot\mathrm{Real}(Z_1(k))+\mathrm{Imag}(Z_1(k))\cdot\mathrm{Imag}(Z_1(k)) \quad \text{(Eq. 6.7)}$$

$$eZ_2(k)=\mathrm{Real}(Z_2(k))\cdot\mathrm{Real}(Z_2(k))+\mathrm{Imag}(Z_2(k))\cdot\mathrm{Imag}(Z_2(k)) \quad \text{(Eq. 6.8)}$$

$$x(k)=\mathrm{Real}(Z_1(k))\cdot\mathrm{Real}(Z_2(k))+\mathrm{Imag}(Z_1(k))\cdot\mathrm{Imag}(Z_2(k)) \quad \text{(Eq. 6.9)}$$

$$w(k)=(x(k))/((eZ_1(k))+L\cdot(eZ_2(k))) \quad \text{(Eq. 6.10)}$$

$$m(k)=((w(k))^2+1)^{1/2}-(w(k)) \quad \text{(Eq. 6.11)}$$

$$Y(k)=(m(k))\cdot(Z_1(k))+(Z_2(k)) \quad \text{(Eq. 6.12)}$$

$$S[k]=(Y(k))\cdot(1-c(k))+(U(k))\cdot c(k) \quad \text{(Eq. 6.13)}$$

Figure 5:
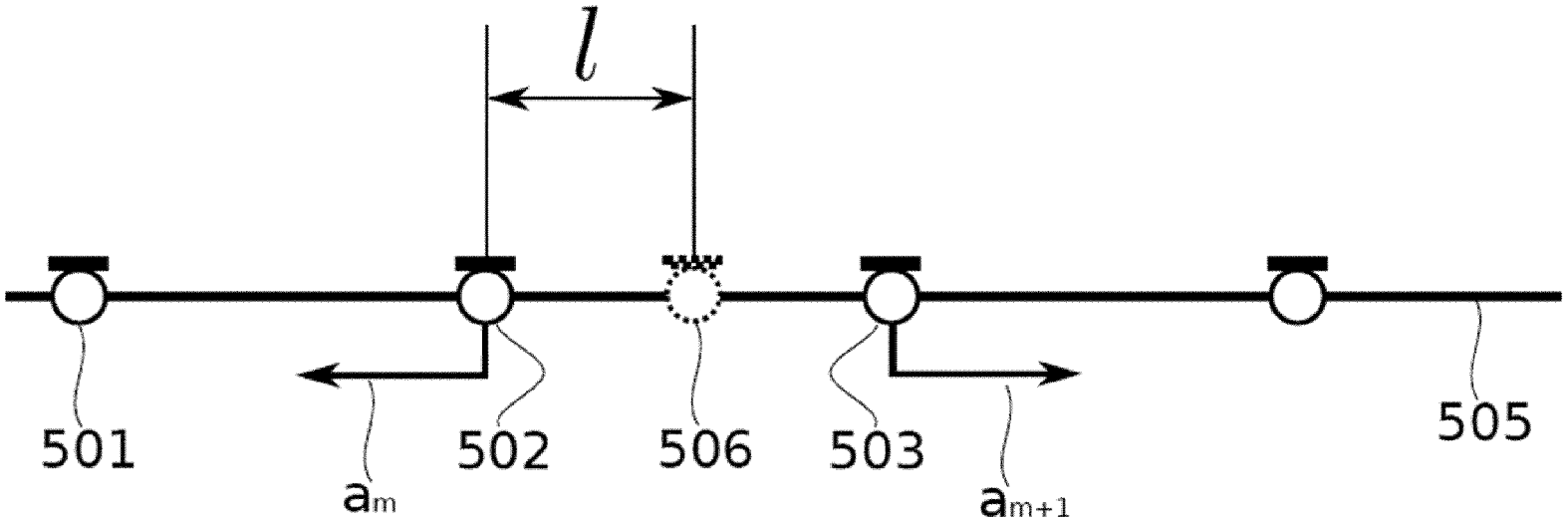

Now it shall be explained by referring to FIG. 5 how the interpolation takes place for a microphone arrangement at least two microphones that are situated on a straight line. FIG. 5 shows such a microphone arrangement including microphones 501, 502, 503, . . . that are arranged on a straight line 505. Now a virtual microphone shall be assumed in the position 506 between microphone 502 (microphone $a_m$) and microphone 503 (microphone $a_{m+1}$), namely, at a distance L from the microphone 502.

The following is now true for r.

$$r=A^*(l-l_m)/(l_{m+1}-l_m) \quad \text{(Eq. 7)}$$

wherein A is a constant, preferably equal to 1, and wherein $l_m$ and $l_{m+1}$ indicate the positions of the two microphones 502 and 503 on the straight line 505 and L is the distance variable indicating the position of the virtual microphone between the two microphones 502 and 503 on the straight line 505. The interpolated microphone signal at the output of the interpolation circuit is then assumed to be the output signal of this virtual microphone 506.

The operation is analogous to the operation already described in the foregoing.

The interpolation circuit may just as well be applied to other microphone arrangements where the microphones are arranged along a curve and not on a straight or circle line.

Figure 6:
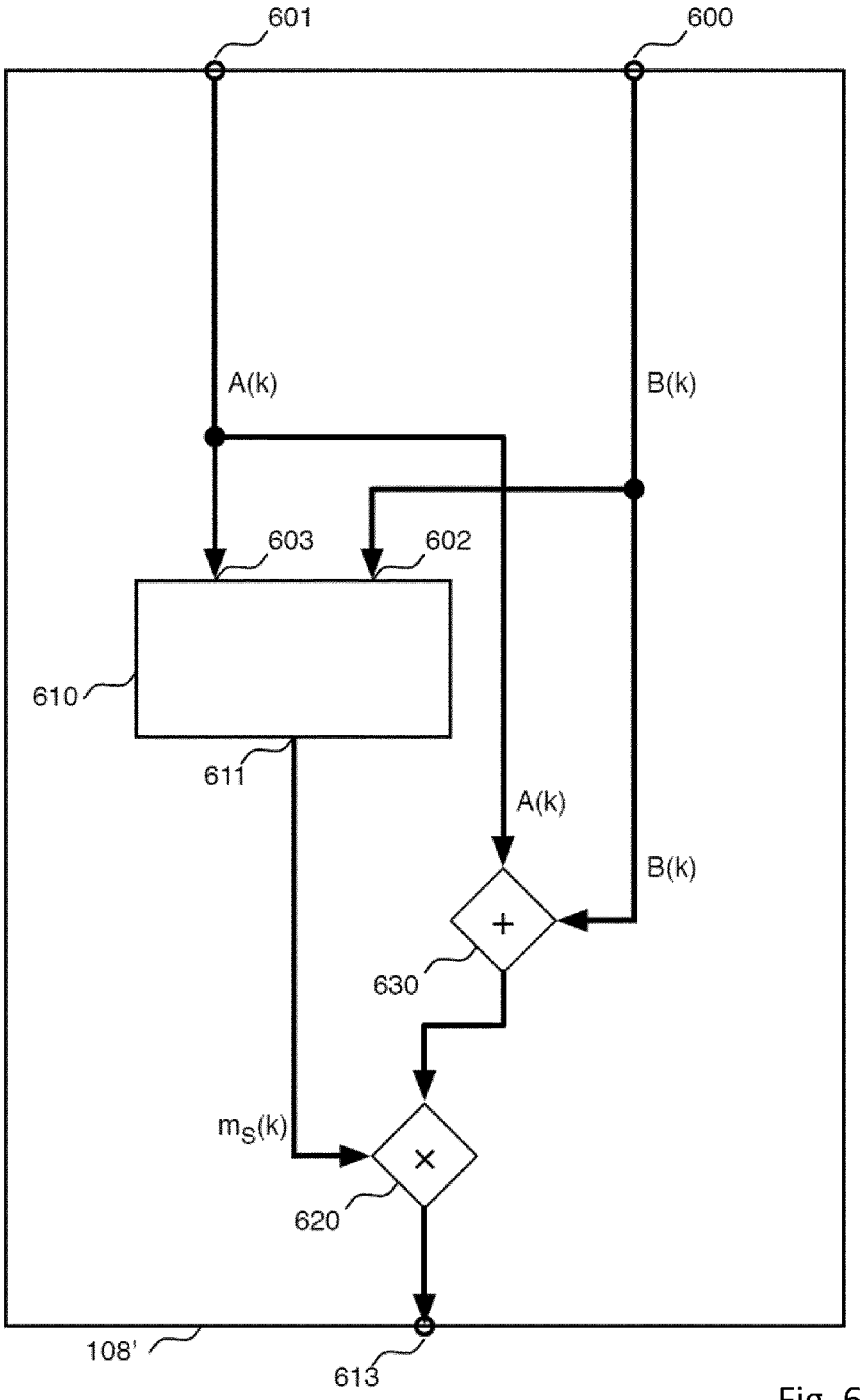

FIG. 6 shows a second practical example of a circuit for power-specific summation, presently indicated by 108'. The means 108' contains a calculation unit 610, a multiplication circuit 620, and a signal combination unit 630. The inputs 601 (127 in FIG. 1) and 600 (126 in FIG. 1) of the means for power-specific summation are coupled to a first and second input 603 and 602, respectively, of the calculation unit 610. An output 611 of the calculation unit 610 is coupled to a first input of the multiplication circuit 620. The two inputs 601, 600 of the means 108' are also coupled to inputs of the signal combination circuit 630. An output of the signal combination circuit 630 is coupled to a second input of the multiplication circuit 620. An output of the multiplication circuit 620 is coupled to the output 613 of the means 108' which has its output 613 coupled to the output 107 of the first circuit branch 104 in FIG. 1. The calculation unit 610 is adapted to derive a multiplication factor $m_S(k)$ in dependence on the signals at the inputs 602 and 603 of the calculation unit.

The operation of the circuit in FIG. 6 is very similar to the one of the circuit in FIG. 2, with the difference that a correction of the output spectral value is now carried out. As a result, the correction jointly relates to all of the inputs and thus brings about symmetry of the effect of the weighting factors of the interpolation g or 1−g to the phase of the spectral value at the output 107 of the first circuit branch 104, which is advantageous for a good adaptation of the phase function of the power-specific interpolation to the phase function of the traditional interpolation.

The multiplication factor in this case is termed $m_S$ and is calculated as follows:

$$eZ_1(k)=\mathrm{Real}(Z_1(k))\cdot\mathrm{Real}(Z_1(k))+\mathrm{Imag}(Z_1(k))\cdot\mathrm{Imag}(Z_1(k)) \quad \text{(Eq. 8.1)}$$

$$eZ_2(k)=\mathrm{Real}(Z_2(k))\cdot\mathrm{Real}(Z_2(k))+\mathrm{Imag}(Z_2(k))\cdot\mathrm{Imag}(Z_2(k)) \quad \text{(Eq. 8.2)}$$

$$x(k)=\mathrm{Real}(Z_1(k))\cdot\mathrm{Real}(Z_2(k))+\mathrm{Imag}(Z_1(k))\cdot\mathrm{Imag}(Z_2(k)) \quad \text{(Eq. 8.3)}$$

$$m_S(k)=((eZ_1(k)+eZ_2(k))/(eZ_1(k)+eZ_2(k)+2\cdot x(k)))^{1/2} \quad \text{(Eq. 8.4)}$$

wherein $m_S(k)$ designates the k-th multiplication factor $Z_1(k)$ designates the k-th complex spectral value of the signal at the input 603 of the calculation unit 610

$Z_2(k)$ designates the k-th complex spectral value of the signal at the input 602 of the calculation unit 610.

Similar to the case of the circuit in FIG. 2 it may be shown by well-known mathematical operations that the corresponding output power eY(k) for the k-th complex output spectral value Y(k) of the signal at the output 613 of the means 108' with $$Y(k)=(Z_1(k)+Z_2(k))\cdot m_S(k) \quad \text{(Eq. 9)}$$

is now equal to the sum of the input powers, i.e.:

$$eY(k)=eZ_1(k)+eZ_2(k).$$

In difference from the circuit in FIG. 2, no disposition for reducing the probability of the occurrence of artefacts perceivable as an interference is contained in this example.

Figure 7:
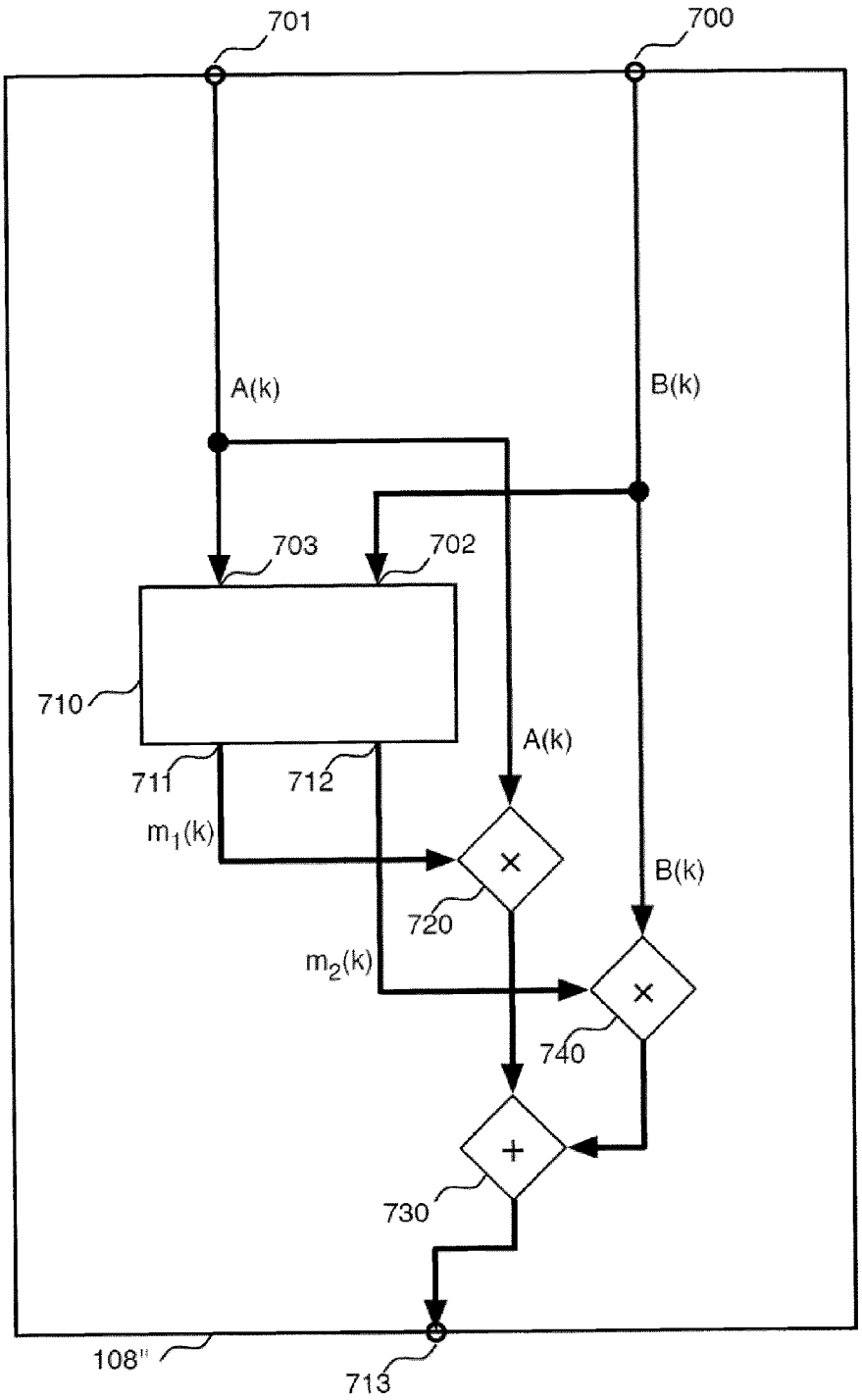

FIG. 7 shows a third practical example of the means 108 for power-specific summation in the first branch 104 in the interpolation circuit of FIG. 1, presently indicated by 108".

The means 108" contains a calculation unit 710, two multiplication circuits 720 and 740, and a signal combination unit 730. The inputs 701 (127 in FIG. 1) and 700 (126 in FIG. 1) of the means 108" are coupled to a first and a second input 703 and 702, respectively, of the calculation unit 710. A first output 711 of the calculation unit 710 is coupled to a first input of the multiplication circuit 720. A second output 712 of the calculation unit 710 is coupled to a first input of the multiplication circuit 740.

The input 700 of the means 108" is coupled to a second input of the multiplication circuit 740. The input 701 of the means 108" is coupled to a second input of the multiplication circuit 720. The outputs of the multiplication circuits 720 and 740 are coupled to respective inputs of the signal combination unit 730. An output of the signal combination unit 730 is coupled to the output 713 of the means 108" which has its output 713 coupled to the output 107 of the first circuit branch 104. The calculation unit 710 is adapted to derive multiplication factors m1(k) and m2(k) in dependence on the signals at the inputs 702 and 703 of the calculation unit 710, and to supply these multiplication factors to the respective outputs 711 and 712.

The practical example in FIG. 7 combines the properties of the mentioned example circuits according to FIG. 2 and FIG. 6 so as to form a circuit, in that a case differentiation is used for changing over between the calculations such that the different equations (Eq. 5.5) and (Eq. 8.4) with their respective properties take effect.

The case differentiation criterion is the sign of x(k), wherein x(k) is defined in accordance with the previously named formulae. The sign differentiates correlated (+) spectral components from anti-correlated (−) spectral components of the input signals, or 0 indicates non-correlated spectral components. The differentiation has the effect of these various spectral components being treated differently.

For correlated spectral components (with x(k)>0) the multiplication factors as in FIG. 6 are utilized, and for anticorrelated or non-correlated spectral components (with x(k)<=0) the multiplication factors as in FIG. 2 are utilized. This has the effect that on the one hand the phase function of the power-specific interpolation is adapted well to the phase function of the traditional interpolation, and on the other hand the probability of the occurrence of artefacts perceivable as an interference is reduced.

The multiplication factors $m_1(k)$ and $m_2(k)$ are accordingly calculated as follows:

$$eZ_1(k)=\mathrm{Real}(Z_1(k))\cdot\mathrm{Real}(Z_1(k))+\mathrm{Imag}(Z_1(k))\cdot\mathrm{Imag}(Z_1(k)) \quad \text{(Eq. 10.1)}$$

$$eZ_2(k)=\mathrm{Real}(Z_2(k))\cdot\mathrm{Real}(Z_2(k))+\mathrm{Imag}(Z_2(k))\cdot\mathrm{Imag}(Z_2(k)) \quad \text{(Eq. 10.2)}$$

$$x(k)=\mathrm{Real}(Z_1(k))\cdot\mathrm{Real}(Z_2(k))+\mathrm{Imag}(Z_1(k))\cdot\mathrm{Imag}(Z_2(k)) \quad \text{(Eq. 10.3)}$$

$$w(k)=x(k)/(eZ_1(k)+L\cdot eZ_2(k)) \quad \text{(Eq. 10.4)}$$

$$m(k)=(w(k)^2+1)^{1/2}-w(k) \quad \text{(Eq. 10.5)}$$

$$m_S(k)=((eZ_1(k)+eZ_2(k))/(eZ_1(k)+eZ_2(k)+2\cdot x(k)))^{1/2} \quad \text{(Eq. 10.6)}$$

$$m_1(k)=m(k)|_{x(k)<=0} \quad \text{(Eq. 10.7.1)}$$

$$m_1(k)=m_S(k)|_{x(k)>0} \quad \text{(Eq. 10.7.2)}$$

$$m_2(k)=1|_{x(k)<=0} \quad \text{(Eq. 10.8.1)}$$

$$m_2(k)=m_S(k)|_{x(k)>0} \quad \text{(Eq. 10.8.2)}$$

wherein $m_1(k)$ and $m_2(k)$ designate the k-th multiplication factors $Z_1(k)$ designates the k-th complex spectral value of the signal at the input 703 of the calculation unit 710

$Z_2(k)$ designates the k-th complex spectral value of the signal at the input 702 of the calculation unit 710

L designates the degree of limitation of the comb filter compensation.

The k-th complex output spectral value Y(k) of the signal at the output 713 of the means 108" is therefore:

$$Y(k)=m_1(k)\cdot Z_1(k)+m_2(k)\cdot Z_2(k). \quad \text{(Eq. 11)}$$

The explanation of the further operation is entirely along the lines of the explanations for FIG. 2 and FIG. 6.

Figure 8:
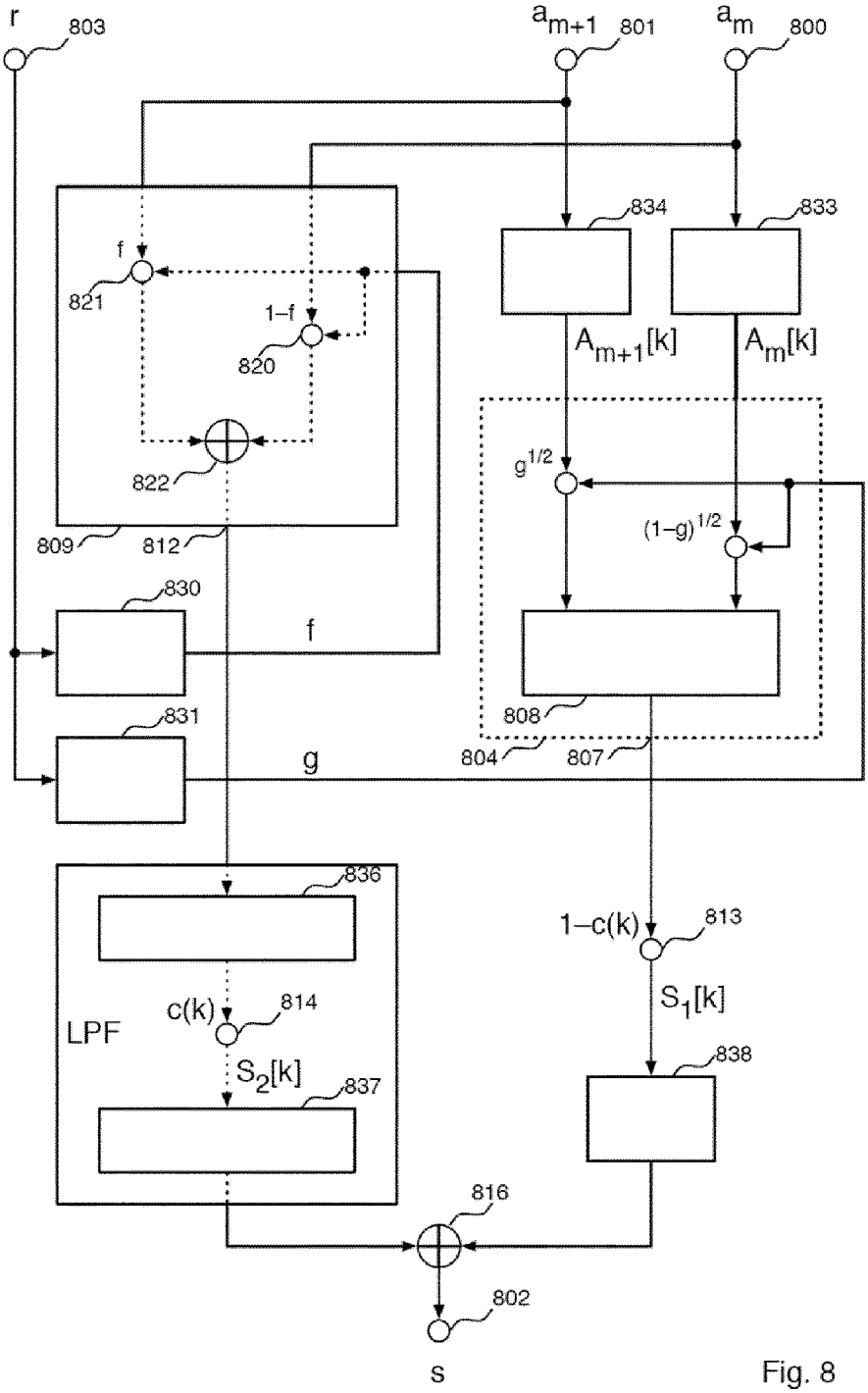

FIG. 8 shows a second practical example of the interpolation circuit of the invention. This circuit is very similar to the circuit according to FIG. 1. The difference resides in the fact that the signal processing in the second branch 809 and in the signal combination circuit 816 are now carried out in the time range and not in the frequency range. This means that the time/frequency converters 833 and 834 in the first branch are disposed downstream from the branching point of the microphone signals $a_m$ and $a_{m+1}$ to the two branches 804 and 809, that a time/frequency converter 836 is disposed upstream of the multiplication circuit 814 and a frequency/time converter 837 downstream from the multiplication circuit 814 in the second branch, and that a frequency/time converter 838 is disposed between the multiplication circuit 813 and the signal combination circuit 816. The operation of the circuit of FIG. 8 thus is identical with the operation of the circuit of FIG. 1.

The invention claimed is:

1. An interpolation circuit for interpolating a first and a second microphone signal and for generating an interpolated microphone signal, comprising:

a first input for receiving the first microphone signal, a second input for receiving the second microphone signal, an output for outputting the interpolated microphone signal, a first circuit branch having first and second inputs coupled to the first and second inputs, respectively, of the interpolation circuit, and an output coupled to the output of the interpolation circuit, the first circuit branch being provided with a means for power-specific summation of the signals supplied at the first and second inputs of the first circuit branch and for outputting a power-specific summation signal at the output of the first circuit branch, wherein the interpolation circuit is further provided with:

a control input for receiving a control signal, a second circuit branch having a first and a second input coupled to the first and second inputs, respectively, of the interpolation circuit, and an output coupled to the output of the interpolation circuit, in that the outputs of the first and second circuit branches are coupled to respective inputs of a signal combination circuit and an output of the signal combination circuit is coupled to the output of the interpolation circuit, in that the second circuit branch is provided with a first multiplication circuit and a second multiplication circuit having inputs coupled to the first and second input of the second circuit branch, respectively, and outputs coupled to respective inputs of a second signal combination circuit whose output is coupled to the output of the second circuit branch, in that the first and second multiplication circuits are provided with a control input coupled to the control input of the interpolation circuit and are adapted to multiply the signals supplied to them by respective first and second multiplication quantities, said first and second multiplication quantities being dependent on the control signal.

2. The interpolation circuit as claimed in claim 1, wherein the first and second microphone signals and the interpolated microphone signal are microphone signals converted into the frequency range, the interpolation circuit further being provided with third and fourth multiplication circuits having inputs coupled to the outputs of the first and second circuit branches, respectively, and an output coupled to the output of the interpolation circuit, in that the third and fourth multiplication circuits are adapted to multiply the signals supplied to them by frequency-dependent multiplication quantities.

3. The interpolation circuit as claimed in claim 2, wherein the frequency-dependent multiplication quantities are equal to 1−c(k) and c(k), respectively, wherein k is a frequency parameter, and in that c(k) satisfies the condition that it is a constant preferably equal to 1 for k=0 and decreases for increasing values of k until c(k) is equal to zero for higher values of k.

4. The interpolation circuit as claimed in claim 1, wherein the two microphone signals are derived from two juxtaposed microphones arranged on a circle ring in a horizontal plane, and with r satisfying the following conditions:

for $\phi=\phi_m$ is a constant, preferably equal to 0, with r increasing for values of $\phi$ passing from $\phi_m$ to $\phi_{m+1}$ until r is a constant, preferably equal to 1, for $\phi=\phi_{m+1}$, wherein $\phi_m$ and $\phi_{m+1}$ are the corner positions of the two microphones on the circle ring and $\phi$ is a corner variable indicating the corner position of a virtual microphone assumed to be arranged on the circle ring between the two microphones, and the interpolated microphone signal at the output of the interpolation circuit is assumed to be the output signal of this virtual microphone.

5. The interpolation circuit as claimed in claim 4, wherein $$r=A*(\phi-\phi_m)/(\phi_{m+1}-\phi_m),$$

wherein A is a constant preferably equal to 1.

6. The interpolation circuit as claimed in claim 4, wherein f satisfies the following conditions:

$f=r^B$, wherein B is a constant greater than zero, preferably equal to 1.

7. The interpolation circuit as claimed in claim 1, wherein the means for power-specific summation includes:

a calculation unit a multiplication circuit a signal combination unit (230), in that the inputs of the means are coupled to respective first and second inputs of the calculation unit, an output of the calculation unit is coupled to a first input of the multiplication circuit, a first input of the means is coupled to a second input of the multiplication circuit, in that an output of the multiplication circuit is coupled to a first input of the signal combination unit, a second input of the means is coupled to a second input of the signal combination unit, and an output of the signal combination unit is coupled to the output of the means, in that the calculation unit is adapted to derive a multiplication factor (m(k)) in dependence on the signals at the inputs of the calculation unit.

8. The interpolation circuit as claimed in claim 7, wherein the means for power-specific summation further includes a second multiplication circuit provided with a first input coupled to the second input of the means, an output coupled to the first input of the signal combination unit, and a second input coupled to a second output of the calculation unit, and in that the calculation unit is further adapted to derive a second multiplication factor ($m_2(k)$) in dependence on the signals at the inputs of the calculation unit and to supply this second multiplication factor to the second output.

9. The interpolation circuit as claimed in claim 1, wherein the first circuit branch is further provided with a fifth multiplication circuit coupled between the first input of the first circuit branch and a first input of the means for power-specific summation, and a sixth multiplication circuit coupled between the second input (106) of the first circuit branch and a second input of the means for power-specific summation.

10. The interpolation circuit as claimed in claim 9, wherein the fifth multiplication circuit is adapted to multiply the signal at its input by a multiplication factor equal to $(1-g)^{1/2}$, and the sixth multiplication circuit is adapted to multiply the signal at its input by a multiplication factor equal to $g^{1/2}$.

11. The interpolation circuit as claimed in claim 10, wherein g satisfies the following conditions:

$g=r^C$, wherein C is a constant greater than zero, preferably equal to 1.

12. The interpolation circuit as claimed in claim 10, wherein g satisfies the following conditions:

$g=\sin^D(r*\pi/2)$, wherein D is a constant greater than zero.

13. The interpolation circuit as claimed in claim 1, wherein the means for power-specific summation includes:

a calculation unit a multiplication circuit a signal combination unit, in that the inputs of the means are coupled to respective first and second inputs of the calculation unit, an output of the calculation unit is coupled to a first input of the multiplication circuit, a first input of the means is coupled to a first input of the signal combination unit, a second input of the means is coupled to a second input of the signal combination unit, and an output of the signal combination unit is coupled to a second input of the multiplication circuit, in that the calculation unit is adapted to derive a multiplication factor ($m_S(k)$) in dependence on signals at the inputs of the calculation unit.

* * * * *